US009723968B2

(12) United States Patent
Fischer et al.

(10) Patent No.: US 9,723,968 B2
(45) Date of Patent: Aug. 8, 2017

(54) DISHWASHER HAVING AN IMPROVED COVER ARRANGEMENT

(75) Inventors: Stefan Fischer, Dinkelscherbenr (DE); Stefan Kasbauer, Dillingen (DE); Norbert Näβler, Aulendorf (DE)

(73) Assignee: BSH Hausgeräte GmbH, Munich (DE)

( * ) Notice: Subject to any disclaimer, the term of this patent is extended or adjusted under 35 U.S.C. 154(b) by 1693 days.

(21) Appl. No.: 13/276,343

(22) Filed: Oct. 19, 2011

(65) Prior Publication Data

US 2012/0098393 A1 Apr. 26, 2012

(30) Foreign Application Priority Data

Oct. 26, 2010 (DE) ..... 10 2010 042 898

(51) Int. Cl.
*A47L 15/42* (2006.01)

(52) U.S. Cl.
CPC ..... *A47L 15/4263* (2013.01); *A47L 15/4209* (2016.11)

(58) Field of Classification Search
CPC ..... A47L 15/4255; A47L 15/4263
USPC ..... 134/58 D, 200, 114; 312/228, 296, 326
See application file for complete search history.

(56) References Cited

U.S. PATENT DOCUMENTS

| | | | | |
|---|---|---|---|---|
| 6,435,366 | B1 * | 8/2002 | Johnson et al. | 220/62.22 |
| 2005/0257816 | A1 * | 11/2005 | Kim | 134/200 |
| 2007/0181168 | A1 * | 8/2007 | Oppel et al. | 134/56 D |
| 2009/0288690 | A1 * | 11/2009 | Haeberle | 134/201 |

FOREIGN PATENT DOCUMENTS

| | | | | |
|---|---|---|---|---|
| DE | 4013771 | A1 * | 10/1991 | A47L 15/42 |
| GB | 2201886 | A * | 9/1988 | A47L 15/42 |

OTHER PUBLICATIONS

English Machine Translation of Description of DE 4013771 (Hoffmann et al., 1991).*

* cited by examiner

*Primary Examiner* — Michael Barr
*Assistant Examiner* — Irina Graf
(74) *Attorney, Agent, or Firm* — Michael E. Tschupp; Andre Pallapies

(57) ABSTRACT

A dishwasher, in particular a household dishwasher, includes a wash container for holding items to be washed. The wash container has a front loading opening and is reinforced by a reinforcement element along at least one front edge region of the wash container. A cover arrangement is provided to at least partially cover at least one gap formed outside a water-conducting region of the wash container between the wash container and at least one surface running along the front edge region of the wash container. The cover arrangement includes at least one cover element having a fastening segment which is defined by an I-shaped cross section and extends in its longitudinal direction parallel to the surface. The I-shaped fastening segment is fixed in a fastening segment having a U-shaped cross section and configured on the reinforcement element.

30 Claims, 3 Drawing Sheets

DISHWASHER HAVING AN IMPROVED COVER ARRANGEMENT

BACKGROUND OF THE INVENTION

The present invention relates to a dishwasher, in particular a household dishwasher, having a wash container for holding items to be washed, which features a front loading opening and a reinforcement element, which reinforces the wash container along at least one front edge region of the wash container, and having a cover arrangement to at least partially cover at least one gap, which results outside a water-conducting region of the wash container between the wash container and at least one surface running along the front edge region of the wash container.

A dishwasher known from practice features a cover element on the top of the front loading opening of its wash container, to cover a gap between a tabletop and the wash compartment. The cover strip also covers a further gap, which is present between the door, in particular along the upper edge region of the door, preferably its inner door, which is provided to close off the wash container, and the wash container, when the door is closed. The cover element here is preferably U-shaped and folded over an upward-pointing edge of a metal reinforcement sheet, which reinforces the wash container of the dishwasher along its front upper edge region.

BRIEF SUMMARY OF THE INVENTION

It is an object of the invention to improve a dishwasher, in particular a household dishwasher, of the type mentioned above.

The object is achieved with a dishwasher of the type mentioned in the introduction in that the cover arrangement comprises at least one cover element having a fastening segment with an I-shaped cross section, running in its longitudinal direction parallel to the respective surface and being fixed in a fastening segment with a U-shaped cross section, which is configured on the reinforcement element.

The front here refers to the face of the dishwasher that faces a user during normal use. Other spatial information, such as "above" or "to the side" relates in this application to the intended use position of the dishwasher. Furthermore an edge region of the wash container refers to a region along an edge of the for example cuboid wash container. The water-conducting region of a wash container here is the region in the interior of the wash container to which wash fluid can be supplied to clean items being washed. The water-conducting region of the wash container is generally bounded by the inner faces of the walls of the wash container, by an inner door of the door assigned to the wash container and in the region between the wash container and the door by a door seal to prevent the egress of wash fluid.

In contrast the cover arrangement disposed outside the water-conducting region can in particular prevent or reduce the penetration of dirt into the gaps covered in each instance by at least one sealing lip of the cover element and/or an egress of sound from the respective gaps, in particular between the top wall of the dishwasher, preferably the top wall of the wash container, and a worktop disposed above this, and/or between the respective side wall of the dishwasher, preferably of its wash container, and a side wall of a recess or laterally adjacent household appliance facing this, and/or between the door and the wash container of the dishwasher along the edge region of its upper face and/or both lateral edge regions.

By configuring an I-shaped fastening segment on the cover element and by configuring a U-shaped fastening segment on the reinforcement element it is possible in a simple manner to produce a tongue and groove connection, connecting the cover element and the reinforcement element. In this process the I-shaped fastening segment of the cover element can act as the tongue and the U-shaped fastening segment of the reinforcement element as the groove.

The configuration of the fastening segment of the reinforcement element in a U shape here increases the rigidity of the reinforcement element in the region of its fastening segment, making the wash container more stable, in particular in the region of its loading opening. It can for example prevent transport damage to the dishwasher. It can also ensure the clean positioning of the door seal between wash container and door, so that gaps and the resulting egress of wash fluid between door and wash container can be avoided, since the improved rigidity of the wash container means that its front upper edge region and/or its two lateral front edge regions, which run vertically roughly 90° to it, preferably run in a largely straight line, so that gaps between the door and the wash container can largely be closed off by a cover strip running in a straight line to follow the respective edge region, said edge strip being configured according to the inventive design principle. Likewise the greater rigidity of the wash container can increase the accuracy of relative positioning between locking elements of the door and locking elements of the wash container, so that it is possible to lock and unlock the door in a simple manner in a closed position.

Since the I-shaped fastening segment can be accommodated in the interior of the U-shaped fastening segment of the reinforcement element, a space-saving arrangement results. In particular the space available for the reinforcement element is increased. This allows the reinforcement element to be embodied with a larger cross section, thereby further increasing its stability. In particular the reinforcement element can extend further toward the front, since the I-shaped fastening segment of the cover element does not have to project beyond the reinforcement element in this direction, as it does with the known solution described above.

According to one advantageous development of the invention, provision is made for the I-shaped fastening segment to be clamped, latched and/or bonded in the U-shaped segment. In particular it is inserted with a form fit, tailored fit, force fit and/or friction fit and/or in some instances a material fit in the U-shaped segment. This allows simple fitting and secure fastening of the cover element. In particular in the case of clamping and/or latching and/or preferably in the case of a tailored and/or form-fit seat it is also possible to replace worn cover elements simply.

According to one advantageous development of the invention the reinforcement element is made of plastic, with the U-shaped fastening segment being configured by primary forming Primary forming is the production of a solid body from formless material by creating cohesion. Possible primary forming methods include in particular gravity casting, centrifugal casting, pressing, injection molding and extruding. It is possible to use both duroplastic and thermoplastic plastics. This allows the U-shaped fastening segment to be configured without complex post-processing of the primary formed reinforcement element.

According to one advantageous development of the invention the arms of the U-shaped fastening segment are aligned parallel to a plane defined by the front edge regions of the wash container. This means that the open side of the U-shaped fastening segment points toward an outer face of the wash container in such a manner that the front of the reinforcement element is not interrupted by the open side of the U-shaped fastening segment, thereby increasing the stability of the reinforcement element and facilitating the attachment of locking elements for locking the door to the wash container.

According to one advantageous development of the invention the cover element features a support segment disposed on the I-shaped fastening segment, with a sealing lip arrangement disposed thereon, which comprises at least one sealing lip to make contact with the respective surface. Such a support segment allows the arrangement of one or more sealing lips as required, these making contact in particular at their free end with the respectively corresponding surface, so that the respective gap is reliably covered.

According to one advantageous development of the invention the I-shaped fastening segment and the support segment together have an L-shaped cross section, preferably a T-shaped cross section. This allows a flat and space-saving configuration of the cover element. When the T shape is used, sealing lips can be disposed in a simple manner on both sides of the I-shaped fastening segment, bringing structural benefits in many instances.

According to one expedient development of the invention the support segment runs perpendicular to the I-shaped fastening segment in cross section and makes at least partial contact with a contact surface on an open side of the U-shaped fastening segment. This allows the cover element to be fastened to the reinforcement element in a particularly stable manner.

According to one expedient development of the invention the sealing lip arrangement comprises at least one sealing lip of the first type to make contact with a movable door, in particular a hinged door, to close off the wash container. This in particular allows the egress of disruptive noise from the wash container during operation to be effectively reduced.

According to one advantageous development of the invention the sealing lip of the first type runs at an angle of at least 25°, preferably at least 35°, particularly preferably at least 40°, and maximum 65°, preferably maximum 55°, particularly preferably maximum 50° to the respective surface provided for contact in the unloaded state. The cited maximum values ensure that the sealing lip of the first type is curved and not kinked when the door is closed. This prevents damage to the respective sealing lip. The cited minimum values ensure that a favorable ratio can be maintained between the size of the sealing lip and the gap to be bridged.

According to one advantageous development of the invention the sealing lip arrangement comprises at least one sealing lip of the second type to make contact with a tabletop disposed above the wash container and/or to make contact with a wall laterally adjacent to the dishwasher, in particular a recess or a side wall of a kitchen cabinet or kitchen appliance. This allows the egress of noise from the dishwasher to be further minimized and also prevents the penetration of dirt into the space between the wash container and tabletop or the space between the dishwasher and the adjacent wall. The tabletop can in particular be one which only closes off the top of the dishwasher or one which closes off the top of the dishwasher and at least one further adjacent kitchen element, for example a kitchen cabinet or kitchen appliance.

According to one advantageous development of the invention the sealing lip of the second type runs at an angle of at least 65°, preferably at least 70°, particularly preferably at least 75°, and maximum 85°, preferably maximum 80° to the respective surface provided for contact in the unloaded state. The cited maximum values ensure that the sealing lip of the second type is curved and not kinked when the tabletop is fitted or when the dishwasher is built into a cabinet or a space in a line of kitchen units comprising one or more kitchen elements. This prevents damage to the respective sealing lip. The cited minimum values ensure that a favorable ratio can be maintained between the size of the sealing lip and the gap to be bridged.

According to one advantageous development of the invention the cover element is a cover strip produced as a single piece from plastic, in particular by extruding. A cover strip here preferably refers to a cover element, which is configured in particular as bar-shaped and has the same cross section at least over a significant part of its length. This shape and the single-piece configuration mean that such a cover strip is easy to produce. In particular the cover strip can be produced using a primary forming method, for example extrusion, and if necessary with just a small amount of post-processing. It is possible to use both duroplastic and thermoplastic plastics.

According to one advantageous development of the invention the cover element is produced as a single piece from different plastics, in particular by extruding or injection molding, using a multicomponent method, so that at least one sealing lip has a lower modulus of elasticity than the support segment and/or the I-shaped fastening segment. In a multicomponent method different plastics are molded in one primary forming step, for example gravity casting, centrifugal casting, pressing, extruding or injection molding, to produce a single workpiece. In this process in particular the respective sealing lips on the one hand and the support segment and the I-shaped fastening segment on the other hand can be provided with different mechanical properties. With a suitable choice of different plastics it is possible for the respective sealing lips to have a relatively low modulus of elasticity, so that when the door is closed for example, at most they produce a small force, which counteracts the closing process. The support segment and the I-shaped fastening segment can expediently have a high modulus of elasticity, in particular a higher modulus of elasticity than the sealing lips, so that the dimensional stability of the cover element and therefore the arrangement as a whole is increased.

According to one advantageous development of the invention the reinforcement element is configured to reinforce the wash container in the region of an upper front edge region of the wash container, with at least one gap running horizontally along the upper front edge region being covered. This allows a gap present there, in particular a gap between the wash container and the tabletop, to be covered and the upper front region of the wash container to be reinforced at the same time. Such reinforcement is particularly useful, as a locking facility or closing facility for the door is generally provided in that region. The reinforcement element can be configured in a simple manner in particular as a horizontal I when viewed from the front. Cover can then be effected in particular by means of a single cover strip.

According to one advantageous development of the invention the reinforcement element is configured to reinforce the wash container in the region of a lateral front edge region of the wash container, with at least one gap running vertically along the lateral front edge region being covered. This allows a gap present there, in particular a gap between the wash container and an adjacent kitchen element to be covered and one of the lateral front regions of the wash container to be reinforced at the same time. The reinforcement element of one of the faces can easily be configured in particular as an upright I when viewed from the front. Cover can in particular be effected by means of a single cover strip on the respective face.

According to one advantageous development of the invention the reinforcement element is configured to reinforce the wash container in the region of an upper front edge region and both lateral front edge regions of the wash container, with at least one gap running horizontally along the upper front edge region and/or at least one gap running vertically along one of the two lateral front edge regions being covered. Upper and lateral gaps can be covered here, it being possible for just one reinforcement element to be expedient, which can in particular have the shape of an inverted U when viewed from the front. The cover arrangement can consist for example of a similarly U-shaped cover element or three cover strips, two of which respectively form the arms and one the base of a U.

The advantageous configurations and developments of the invention described above and/or set out in the subclaims can—except for example in cases of clear dependencies or incompatible alternatives—be applied individually or in any combination with one another.

BRIEF DESCRIPTION OF THE DRAWINGS

The invention and its advantageous configurations and developments and their advantages are described in more detail below with reference to drawings, which illustrate by means of basic diagrams.

DETAILED DESCRIPTION OF EXEMPLARY EMBODIMENTS OF THE PRESENT INVENTION

Figure 1:
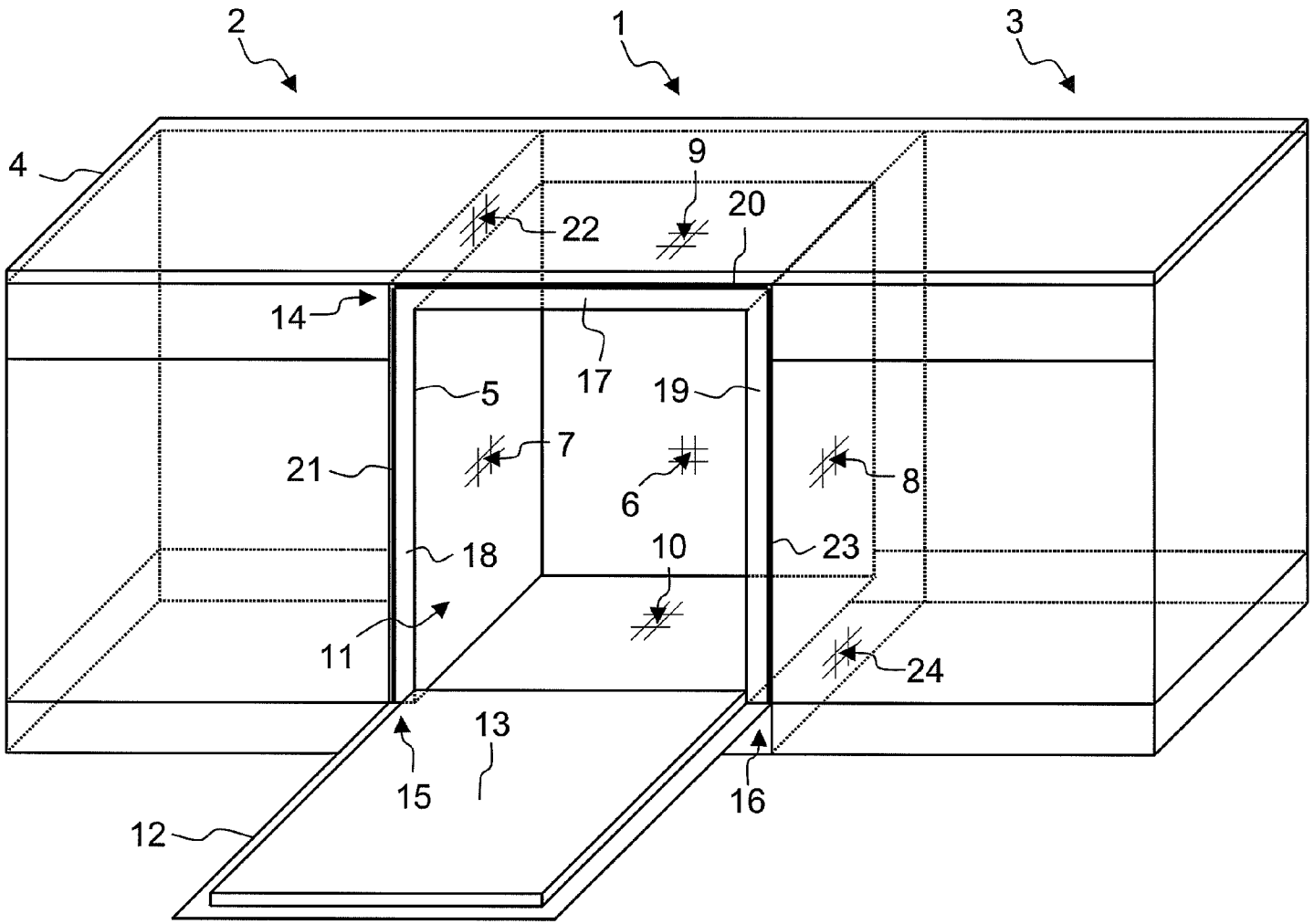
FIG. 1 a schematic three-dimensional diagram of an advantageous exemplary embodiment of an inventively structured dishwasher built into a line of kitchen units, FIG. 2 a lateral cross-section through the cover strip of the exemplary embodiment from FIG. 1, FIG. 3 a lateral cross-section through a reinforcement element of the dishwasher from FIG. 1, and FIG. 4 a detail of an upper region of the dishwasher from FIG. 1 in cross section and viewed from the side.

In the figures below corresponding parts are shown with the same reference characters. In the figures only components of a dishwasher that are necessary for an understanding of the invention are shown with a reference character and described. It goes without saying that the inventive dishwasher can comprise further parts and assemblies.

FIG. 1 shows an advantageous exemplary embodiment of an inventive household dishwasher 1. It is part of a line of kitchen units 1, 2, 3, comprising by way of example the dishwasher 1, a first laterally adjacent kitchen cabinet 2 and a second laterally adjacent kitchen cabinet 3. The dishwasher 1, the first kitchen cabinet 2 and the second kitchen cabinet 3 are covered at the top by a common tabletop 4, the top face of which is provided as a work surface and allows the performance of kitchen tasks.

The dishwasher 1 has a wash container 5, which comprises a rear wall 6, a first side wall 7, a second side wall 8, a top wall 9 and a bottom wall 10.

On the front, which faces a user during normal use of the dishwasher 1, the wash container 5 has a loading opening 11, which can be closed by means of a door 12, 13 supported in a movable fashion. This latter comprises an outer door 12 facing the user and an inner door 13 facing into the interior of the wash container.

The door 12, 13 is shown in its open position in FIG. 1, allowing items to be washed to be loaded into the wash container 5 and washed items to be taken out of the wash container 5. The door 12, 13 can be pivoted about a horizontal axis (not shown) so that it can be moved from the illustrated open position into a closed position. The inner door 13 here is made of stainless steel sheet and corresponds to the loading opening 11 of the wash container 5, so that in conjunction with a door seal (not shown in FIG. 1) when the door 12, 13 assumes the closed position a water-conducting region that is closed on all sides for processing items to be washed is produced in the interior of the wash container 5.

Above the loading opening 11 the essentially cuboid wash container 5 features an upper front edge region 14 extending in the transverse or widthwise direction, on a first side of the loading opening 11 a first lateral front edge region 15 extending in a heightwise direction and on a second side of the loading opening 11 a second lateral front edge region 16 extending in a heightwise direction. In the region of the loading opening 11 the wash container 5 is less stable, for example compared with the rear wall 6.

A reinforcement element 17, 18, 19 is therefore provided, having the shape of an upside down U. Generally the reinforcement element 17, 18, 19 can be configured as a single piece or be made up of a number of sub-elements. A horizontal segment 17 of the reinforcement element 17, 18, 19 here runs along the upper front edge region 14 and reinforces it. A first vertical segment 18 of the reinforcement element 17, 18, 19 also runs along the first lateral front edge region 15 and reinforces it. Similarly a second vertical segment 19 of the reinforcement element 17, 18, 19 runs along the second lateral front edge region 16 and reinforces this latter. However the invention can generally also be applied if the reinforcement element 17, 18, 19 is only configured to reinforce selected edge regions 14, 15, 16, for example in particular to reinforce the upper front edge region 14.

Provided on the reinforcement element 17, 18, 19 is a cover arrangement 20, 21, 23, which covers gaps running along the edge regions 14, 15 and 16, thereby preventing the penetration of dirt into the respective gaps and at least reducing the egress of unwanted noise from the gaps. Generally the cover arrangement 20, 21, 23 can be configured as a single piece or be made up of several cover elements, which are individual cover strips 20, 21, 23 that are simple to produce, as in the exemplary embodiment.

In the exemplary embodiment a first cover strip 20 is fastened to the horizontal segment 17 of the reinforcement element 17, 18, 19, covering a gap or free space extending in a heightwise direction between the wash container 5 and the tabletop or worktop 4, in particular between the segment 17 of the reinforcement element 17, 18, 19 and the tabletop 4, as well as a further gap between the wash container 5—or the segment 17 of the reinforcement element 17, 18, 19—and the door 12, 13, when this is closed.

Also in the exemplary embodiment a second cover strip 21 is fastened to the first vertical segment 18 of the reinforcement element 17, 18, 19, covering a gap extending in a widthwise direction between the wash container 5—or the segment 18 of the reinforcement element 17, 18, 19—and a side wall 22 of the first adjacent kitchen cabinet 2 or another surface running along the front lateral edge region 15 as well as a further gap extending in a widthwise direction between the wash container 5—or the segment 18 of the reinforcement element 17, 18, 19—and the door 12, 13, when this is closed.

Similarly in the exemplary embodiment a third cover strip 23 is fastened to the second vertical segment 19 of the reinforcement element 17, 18, 19, covering a gap extending in a widthwise direction between the wash container 5—or the segment 19 of the reinforcement element 17, 18, 19—and a side wall 24 of the second adjacent kitchen cabinet 3 or another surface running along the front edge region 16 as well as a further gap extending in a widthwise direction between the wash container 5—or the segment 18 of the reinforcement element 17, 18, 19—and the door 12, 13, when this is closed.

In the exemplary embodiment the cover elements 20, 21, 23 are cover strips 20, 21, 23, each produced as a single piece from plastic, in particular by extruding.

Figure 2:
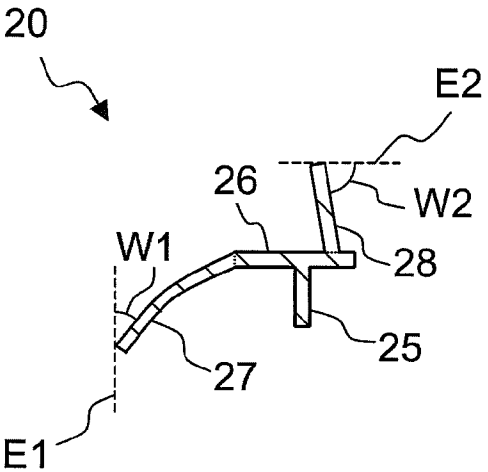

FIG. 2 shows an exemplary cross section through the first cover strip 20, which remains essentially the same, at least over a significant part of the longitudinal extension of the first cover strip 20. The second cover strip 21 and the third cover strip 23 can be structured in the same manner.

The cover strip 20 has an I-shaped fastening segment 25 and a support segment 26 disposed thereon, together forming a T shape, thereby creating a stable but compact arrangement. Disposed on the support segment 26 is a sealing lip 27 of the first type, which is provided to make contact with the door 12, 13, when this is closed, to cover a gap between wash container 5 and door 12, 13. Also disposed on the support segment 26 is a sealing lip 28 of the second type, which is provided to make contact with the tabletop 4 disposed above the dishwasher.

FIG. 2 shows a plane El, which runs parallel to a contact surface of the door 12, 13, when this is closed. The sealing lip 27 of the first type here runs at an angle W1 of at least 25°, preferably at least 35°, particularly preferably at least 40°, and maximum 65°, preferably maximum 55°, particularly preferably maximum 50° to the plane El or the contact surface of the door 12, 13 in the unloaded state. The cited maximum values ensure that the sealing lip 27 of the first type is curved and not kinked when the door 12, 13 is closed. This prevents damage to the sealing lip 27. The cited minimum values ensure that a favorable ratio can be maintained between the size of the sealing lip 27 and the gap to be bridged FIG. 2 shows a further plane E2, which runs parallel to a contact surface of the tabletop 4. The sealing lip 28 of the second type here runs at an angle W2 of at least 65°, preferably at least 70°, particularly preferably at least 75°, and maximum 85°, preferably maximum 80° to the plane E2 or the contact surface of the tabletop 4 in the unloaded state. The cited maximum values ensure that the sealing lip 28 of the second type is curved and not kinked when the tabletop 4 is fitted or when the dishwasher 1 is built into a cabinet or a space in a line of kitchen units comprising a number of kitchen elements 1, 2, 3. This prevents damage to the sealing lip 28. The cited minimum values ensure that a favorable ratio can be maintained between the size of the sealing lip 28 and the gap to be bridged.

In the exemplary embodiment the cover strips 20, 21, 23 are each produced as a single piece from different plastics, in particular by extruding or injection molding, using a multicomponent method, so that the sealing lips 27 and 28 have a lower modulus of elasticity than the support segment 26 and/or the I-shaped fastening segment 25. The sealing lip 27 here can have a relatively low modulus of elasticity, so that when the door is closed for example, at most it produces a small force, which counteracts the closing process. The sealing lip 28 can also have a low modulus of elasticity, which can facilitate the building in of the dishwasher. The support segment 26 and the I-shaped fastening segment 25 can have a high modulus of elasticity, so that the dimensional stability of the cover strips 20, 21, 23 is increased. Generally speaking the modulus of elasticity of the support segment and of the I-shaped fastening segment is selected to be higher or greater than the modulus of elasticity of the sealing lips of the respective cover strip.

Figure 3:
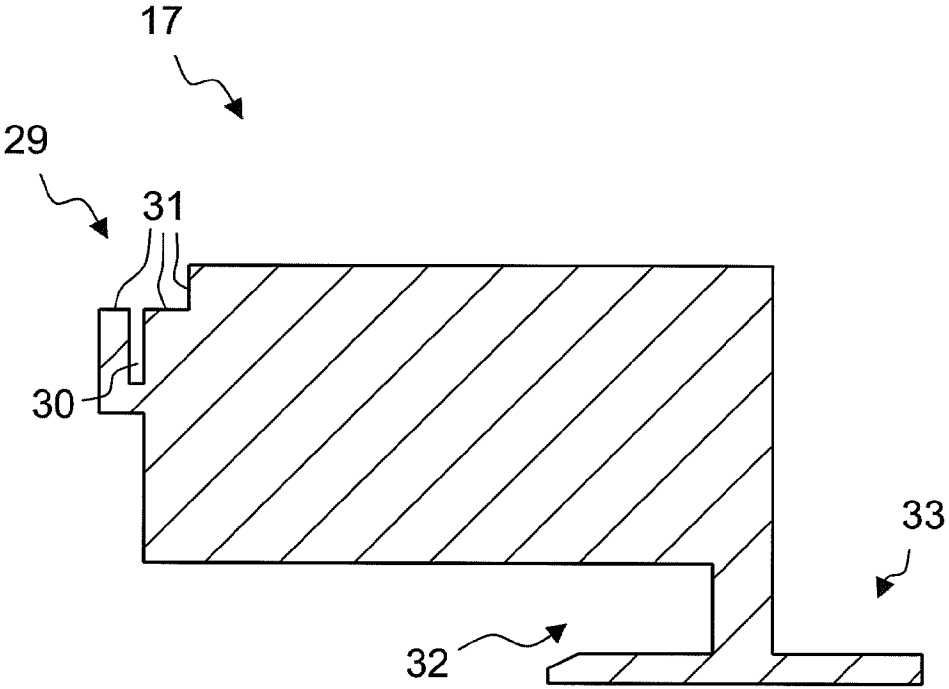

FIG. 3 shows an exemplary cross section through the segment 17 of the reinforcement element 17, 18, 19 viewed from the side, i.e. viewed from a position in a lane spanned by the heightwise and depthwise directions of the wash container. A U-shaped fastening segment 29 here serves to fasten the cover strip 20. To this end a groove-type opening 30 is provided to hold the I-shaped fastening segment 25 of the cover strip 20. In the exemplary embodiment here the I-shaped fastening segment 25 can be clamped to the U-shaped fastening segment 29. Alternatively or additionally provision can be made for latching and/or bonding. It can in particular be expedient for the outer contour of the I-shaped fastening segment to correspond to the inner contour of the U-shaped fastening segment. This advantageously allows the I-shaped fastening segment to sit with a tailored fit in the U-shaped fastening segment. Generally speaking the I-shaped fastening segment can be inserted and held in the U-shaped fastening segment with a force, form and/or friction fit.

On an open side of the U-shaped fastening segment 29 the segment 17 of the reinforcement element 17, 18, 19 has a contact surface 31, provided for contact with the support segment 26 over a large area. This allows particularly stable fastening of the cover strip 20 to the reinforcement element 17, 18, 19.

A fastening segment 32 for a door seal and a fastening segment 33 for the top wall 9 of the wash container are also configured on the segment 17 of the reinforcement element 17, 18, 19. Fastening segments 32 for the door seal and fastening segments 33 for the first and second side walls 7, 8 can likewise be configured in the segments 18 and 19.

The reinforcement element 17, 18, 19 in the exemplary embodiment here is made of plastic, with the U-shaped fastening segment 29 in particular being configured by primary forming Possible primary forming methods include in particular gravity casting, centrifugal casting, pressing, injection molding and extruding. It is possible to use both duroplastic and thermoplastic plastics. This allows the U-shaped fastening segment to be configured without complex post-processing of the primary formed reinforcement element 17, 18, 19.

The arms of the U-shaped fastening segment 29 are advantageously aligned parallel to a plane defined by the front edge regions 14, 15, 16 of the wash container 5. This means that the open side of the U-shaped fastening segment 29 points toward an outer face of the wash container 5 in such a manner that the front of the reinforcement element 17, 18, 19 is not interrupted by the open side of the U-shaped fastening segment 29, thereby increasing the stability of the reinforcement element 17, 18, 19 and facilitating the attachment of locking elements for locking the door 12, 13 to the wash container 5.

Figure 4:
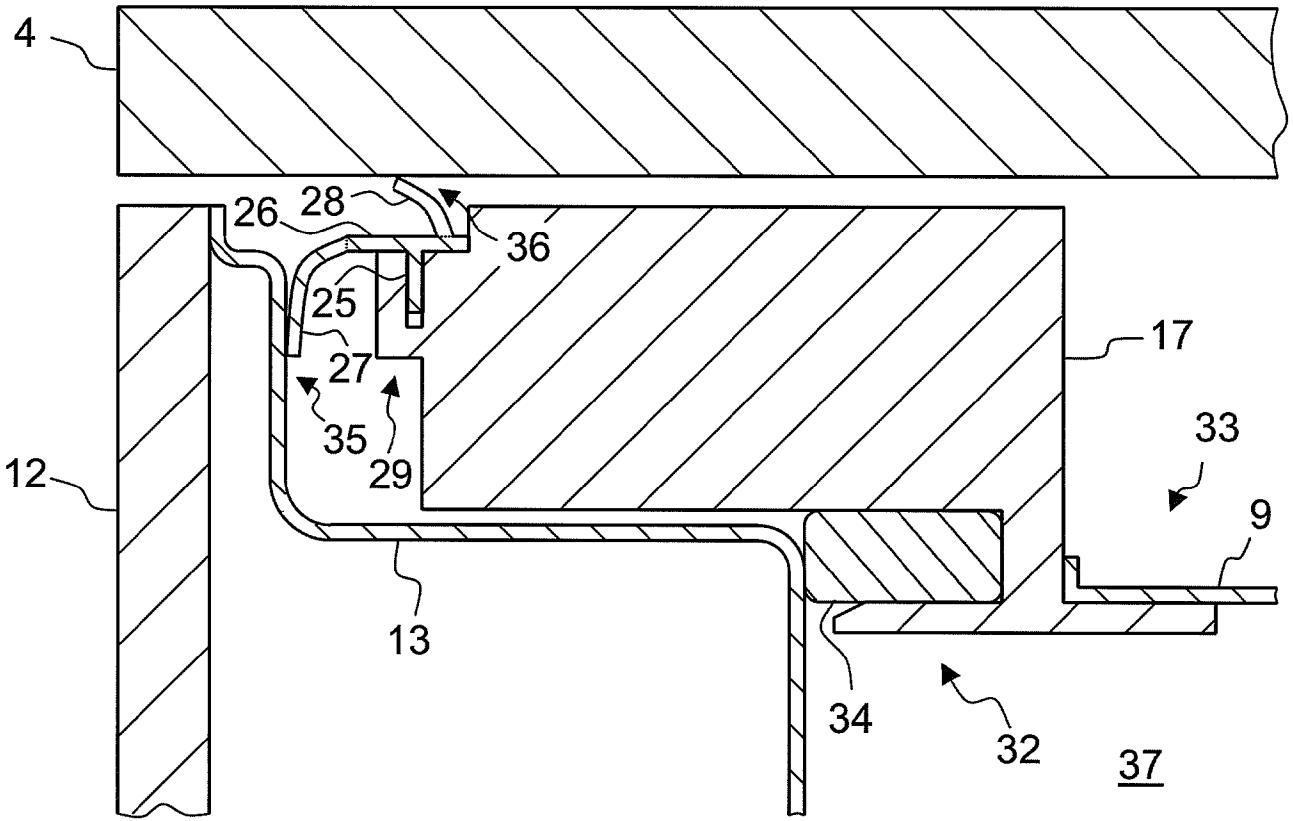

FIG. 4 shows a side view of an upper front segment of the exemplary embodiment in cross section. The door 12, 13 is shown here in its closed position, with the inner door 13 in contact with a door seal 34. The top wall 9 is also fastened to the fastening segment 33, for example by bonding or screwing.

The cover strip 20 here is fixed as intended with its I-shaped fastening segment in the U-shaped fastening segment 29 of the segment 17 of the reinforcement element 17, 18, 19. The sealing lip 27 of the first type here changes shape to make contact with a surface 35 of the door 12, 13, more specifically the inner door 13, with particularly effective contact being brought about due to elastic restoring forces. Similarly the sealing lip 28 of the second type changes shape to make contact with a surface 36 of the tabletop 4, again with particularly effective contact being brought about due to elastic restoring forces. The cover strip 20 here covers gaps that are outside the water-conducting region 37 of the wash container 5.

By configuring the I-shaped fastening segment 25 on the cover strip 20 and by configuring the U-shaped fastening segment 29 on the reinforcement element 17, 18, 19 it is possible in a simple manner to produce a tongue and groove connection, connecting the cover strip 20 and the reinforcement element 17, 18, 19. In this process the I-shaped fastening segment 25 of the cover strip 20 can act as the tongue and the U-shaped fastening segment 29 of the reinforcement element 17, 18, 19 as the groove.

The configuration of the fastening segment 29 of the reinforcement element 17, 18, 19 in a U shape here increases the rigidity of the reinforcement element 17, 18, 19 in the region of its fastening segment 29, making the wash container 5 more stable, in particular in the region of its loading opening 11. It can for example prevent transport damage to the dishwasher 1. It can also ensure the clean positioning of the door seal 34 between wash container 5 and door 12, 13, so that gaps and the resulting egress of wash fluid between door 12, 13 and wash container 5 can be avoided. Likewise the greater rigidity of the wash container 5 can increase the accuracy of relative positioning between one or more locking elements (not shown) of the door 12, 13 and one or more locking elements (also not shown) of the wash container 5, so that it is possible to lock and unlock the door 12, 13 in a simple manner in a closed position.

Since the I-shaped fastening segment 25 can be held in the interior of the U-shaped fastening segment 29 of the reinforcement element 17, 18, 19, a space-saving arrangement results. In particular the space available for the reinforcement element 17, 18, 19 is increased. This allows the reinforcement element 17, 18, 19 to be embodied with a larger cross section, thereby further increasing its stability. In particular the reinforcement element 17, 18, 19 can extend further toward the front, since the I-shaped fastening segment 25 of the cover strip 20 does not have to project beyond or fold over the reinforcement element 17, 18, 19 in this direction.

With the invention a U-profile 29 is provided, which is disposed on, in particular injected onto, a reinforcement element 17, 18, 19, for example a plastic frame 17, 18, 19. The fastening segment 25 of the cover 20, 21, 23 is fixed therein, so that it does not extend forward. The cover 20, 21, 23 can in particular be configured in an L shape. The attachment of the U shape 29 at the same time ensures the stabilization of the reinforcement element 17, 18, 19.

In the context of the invention the I-shaped fastening segment refers in particular to an essentially straight web segment, which projects from the cover strip and is made to engage with the U-shaped fastening segment of the reinforcement element.

What is claimed is:

1. A dishwasher, comprising:

a wash container for holding items to be washed, said wash container having a front loading opening, and said washing container having washing container walls;

a reinforcement element to reinforce the wash container along at least one front edge region of the wash container, said reinforcement element positioned adjacent to at least one of the washing container walls; and a cover arrangement to at least partially cover at least one gap formed outside a water-conducting region of the wash container between the wash container and at least one surface running along the front edge region of the wash container, said cover arrangement comprising at least one cover element having a fastening segment which is defined by an I-shaped cross section, said I-shaped fastening segment extending in a longitudinal direction parallel to the at least one surface, said I-shaped fastening segment extending into and being fixed in a fastening segment having a U-shaped cross section defined by at least one arm, and the reinforcement element comprising said U-shaped fastening segment, wherein a tongue and groove connection is formed between the I-shaped fastening segment and the U-shaped fastening segment.

2. The dishwasher of claim 1, is a household dishwasher.

3. The dishwasher of claim 1, wherein the I-shaped fastening segment is fixed in the U-shaped fastening segment by at least one of clamping, latching, bonding.

4. The dishwasher of claim 1, wherein the reinforcement element is made of plastic, with the U-shaped fastening segment being configured by primary forming.

5. The dishwasher of claim 1, wherein the at least one arm of the U-shaped fastening segment is aligned parallel to a plane defined by the front edge region of the wash container.

6. The dishwasher of claim 1, wherein the cover element includes a support segment disposed on the I-shaped fastening segment, further comprising a sealing lip arrangement disposed on the support segment and including at least one sealing lip to make contact with the at least one surface.

7. The dishwasher of claim 6, wherein the I-shaped fastening segment and the support segment together have an L-shaped cross section.

8. The dishwasher of claim 6, wherein the I-shaped fastening segment and the support segment together have a T-shaped cross section.

9. The dishwasher of claim 6, wherein the support segment is positioned perpendicular to the I-shaped fastening segment in cross section and makes at least partial contact with a contact surface on an open side of the U-shaped fastening segment.

10. The dishwasher of claim 6, further comprising a movable door to close off the wash container, said at least one sealing lip comprising at least one first sealing lip positioned to make contact with the door.

11. The dishwasher of claim 10, wherein the door is a pivotable door.

12. The dishwasher of claim 10, wherein the at least one first sealing lip is positioned at an angle of at least 25° in an undeformed state relative to the at least one surface to be contacted by the at least one first sealing lip.

13. The dishwasher of claim 12, wherein the angle is at least 35°.

14. The dishwasher of claim 12, wherein the angle is at least 40°.

15. The dishwasher of claim 12, wherein the angle is maximum 65°.

16. The dishwasher of claim 12, wherein the angle is maximum 55°.

17. The dishwasher of claim 12, wherein the angle is maximum 50°.

18. The dishwasher of claim 6, wherein the at least one sealing lip comprises at least one second sealing lip to make contact with at least one member, said at least one member comprising at least one of a tabletop disposed above the wash container and a wall laterally adjacent to the dishwasher.

19. The dishwasher of claim 18, wherein the wall is a side wall of a kitchen cabinet or a kitchen appliance.

20. The dishwasher of claim 18, wherein the at least one second sealing lip is positioned at an angle of at least 65° in an undeformed state relative to the at least one surface to be contacted by the at least one second sealing lip.

21. The dishwasher of claim 20, wherein the angle is at least 70°.

22. The dishwasher of claim 20, wherein the angle is at least 75°.

23. The dishwasher of claim 20, wherein the angle is maximum 85°.

24. The dishwasher of claim 20, wherein the angle is maximum 80°.

25. The dishwasher of claim 6, wherein the cover element is produced as a single piece from different plastics using a multicomponent method, so that the at least one sealing lip has a lower modulus of elasticity than at least one of the support segment and the I-shaped fastening segment.

26. The dishwasher of claim 25, wherein the cover element is produced by extruding or injection molding.

27. The dishwasher of claim 1, wherein the cover element is a cover strip produced as a single piece from plastic.

28. The dishwasher of claim 1, wherein the cover element is produced by extruding.

29. The dishwasher of claim 1, wherein the reinforcement element is configured to reinforce the wash container in a region of an upper front edge region of the wash container, the at least one gap comprising a horizontal gap running horizontally along the upper front edge region, and said horizontal gap being covered by the cover arrangement.

30. The dishwasher of claim 1, wherein the reinforcement element is configured to reinforce the wash container in a region of a lateral front edge region of the wash container, the at least one gap comprising a vertical gap running vertically along the lateral front edge region, and said vertical gap being covered by the cover arrangement.

* * * * *